US005605001A

United States Patent [19]

Derk

[11] Patent Number: 5,605,001

[45] Date of Patent: Feb. 25, 1997

[54] ORNAMENTAL SCROLL DEVICE

[76] Inventor: Laura J. Derk, P.O. Box 68, Cheboygan, Mich. 49721

[21] Appl. No.: 208,387

[22] Filed: Mar. 10, 1994

[51] Int. Cl.[6] ..... G09F 11/18

[52] U.S. Cl. ..... 40/518; 40/117

[58] Field of Search ..... 40/117, 518, 519, 40/520, 630, 659; D11/131, 132, 133, 117, 121

[56] References Cited

U.S. PATENT DOCUMENTS

| | | | |
|---|---|---|---|
| 321,668 | 7/1885 | Wirths | 40/153 |
| D. 328,572 | 8/1992 | Dudley | D11/121 X |
| D. 355,391 | 2/1995 | Derk | D11/133 |
| D. 368,052 | 3/1996 | Mendez | D11/132 X |
| 387,784 | 8/1988 | Hack | 40/518 X |
| 2,980,325 | 4/1961 | Pisarra | 40/518 X |
| 3,006,793 | 10/1961 | Wheeler, III | 40/630 X |
| 3,797,148 | 3/1974 | Ivengsbeng et al. | 40/117 |
| 3,812,609 | 5/1974 | Volden | 40/153 X |
| 3,965,599 | 6/1976 | Ebner | 40/600 X |
| 4,646,453 | 3/1987 | Reinhart | 40/117 |
| 4,837,953 | 6/1989 | Tannenbaum | 40/600 X |

*Primary Examiner*—Peter M. Cuomo
*Assistant Examiner*—James O. Hansen
*Attorney, Agent, or Firm*—Neil F. Markva

[57] ABSTRACT

An ornamental scroll device comprises a flexible sheet including two opposed outer end portions two opposed outer edges, and an indicia bearing section having a message located on an obverse side of the flexible sheet and between the end portions and outer edges. A stiffening member maintains the indicia bearing section rigid between the outer end portions. Each of the outer end portions includes a roll section having two end caps secured at opposite ends of each roll section. A hanging or folding member is used for displaying the indicia bearing section.

13 Claims, 1 Drawing Sheet

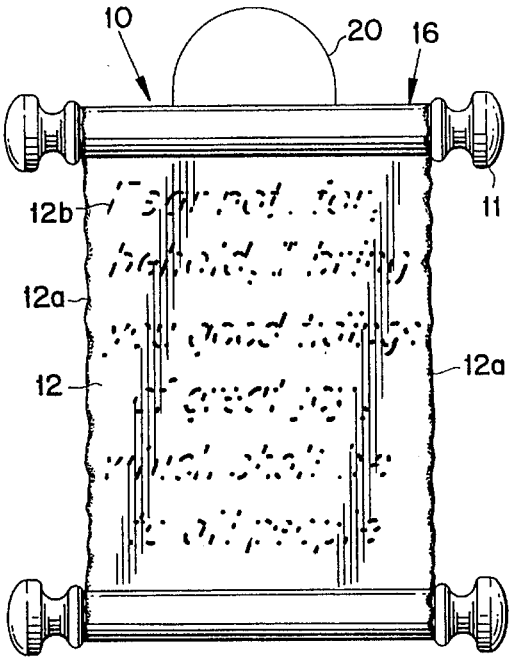
FIG. 1
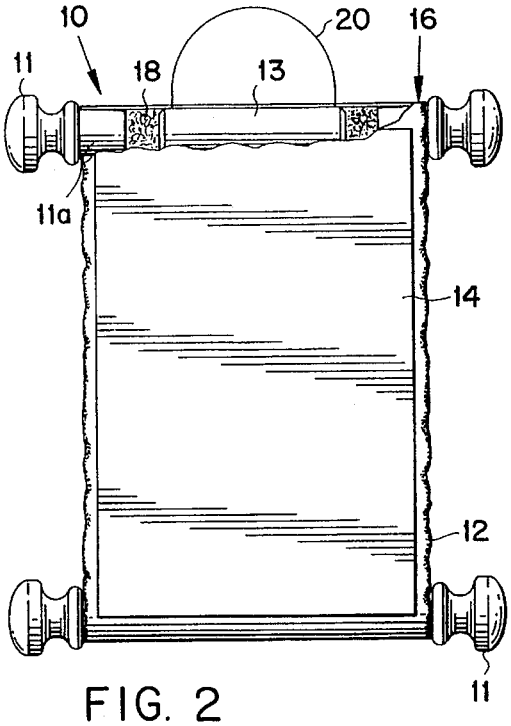
FIG. 2
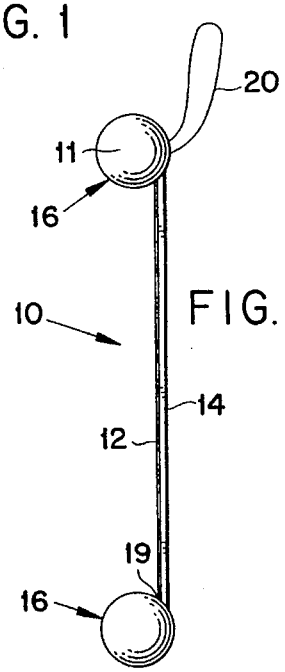
FIG. 3
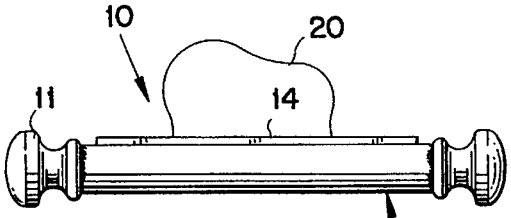
FIG. 4
FIG. 5
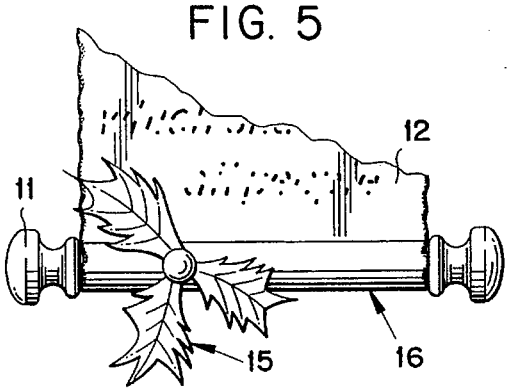

ORNAMENTAL SCROLL DEVICE

FIELD OF THE INVENTION

This invention relates to an ornamental scroll device bearing a message related to a particular theme.

BACKGROUND OF THE INVENTION

The use of ornamental devices to display various messages for different purposes such as Christmas tree ornaments, refrigerator magnets, and wall hangings are very well known. Various design patents have been issued for such ornamental devices including Design Patents D19,456; D41,309; D50,606; D253,150; D267,020; D318,605; D328,572; and D328,724.

Design patent D100,103 is directed to a design for a message scroll that has a flexible sheet that moves between a rolled and an extended condition.

Design patent D267,020 discloses a magnetic memo holder that includes a single dimension representation of a scroll.

None of the above patents disclose a particular configuration such as is found in the present application.

SUMMARY OF THE INVENTION

The invention is directed to an ornamental scroll device comprising flexible sheet means including two opposed outer end portions, two opposed outer edges, and an indicia bearing section having a message located on an obverse side of the flexible sheet means and between the end portions and outer edges.

Stiffening means maintain the indicia bearing section rigid between the outer end portions. Each outer end portion includes a roll section having two cap means secured at opposite ends thereof. The device includes location fixing means for displaying the indicia bearing section.

In one embodiment, the stiffening means includes at least one rigid member secured to a reverse side of the flexible sheet means. The rigid member is effective to fix the flexible sheet means in an outstretched condition. In the specific embodiment, the rigid member is a single rigid sheet of material adhesively secured to the reverse side of the flexible sheet means.

The location fixing means may include a flexible line or a magnet means either of which is secured to the stiffened flexible sheet means. Thus, the device may be either hung for display of the indicia bearing section, or magnetically held for display, respectively.

A feature of the invention is directed to the location fixing means including a flexible line that has two end sections fixed to the device for hanging the device for display of the indicia bearing section. In a specific embodiment, the two end sections of the flexible line are disposed between the rigid sheet of material and the flexible sheet means to which the rigid sheet material is adhesively secured.

Another feature of the invention is directed to the roll section, which includes a dowel section located between two cap means. In a specific embodiment, the flexible sheet means includes a single piece of sheet material having outer end sections wrapped around the circumferential surfaces of the dowel sections to form the outer end portions. The dowel sections have a length that is shorter than the overall width of the sheet material to provide open-mouth pockets for receiving a cap means at each end of the roll section.

In a specific embodiment, each cap means includes a coupling section and an outer head section wherein the coupling section of each cap means is fixedly disposed in an open-mouth pocket at the end of each roll section. More particularly, each end cap means comprises a single member having a knob section and a coupling section. Each coupling section is adhesively secured with the pockets while exposing the knob sections that project outwardly from the ends of the roll sections.

Other features of the invention are directed to a charred edge structure along the two opposed outer edges of the flexible sheet means. Further, the flexible sheet means may include a theme-related article disposed thereon to augment the message of the indicia bearing section.

In another specific embodiment, the ornamental scroll device comprises a single flexible sheet of material including two opposed outer end portions, two opposed outer edges, and an indicia bearing section having a message disposed on an obverse side of the flexible sheet. Stiffening means maintain the indicia bearing section in an outstretched condition between the outer end portions. Each of the outer end portions include a roll section having a cap member secured at opposite ends of each roll section and location fixing means for displaying the indicia bearing section.

Each cap member has a knob section and a coupling section with each dowel section circumferential surface being adhesively secured to the flexible sheet outer end portion that is rolled about the entire circumferential surface to form the roll section. The coupling section of each cap member at each end of the roll section is adhesively secured within the pockets while exposing the knob sections that project outwardly from the ends of the roll sections. The roll sections are adhesively secured to an outer end edge of the indicia bearing section.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

FIG. 1 is a front elevational view of an ornamental scroll device in accordance with the invention;

FIG. 2 is a fragmentary rear elevational view of the device of FIG. 1;

FIG. 3 is a right side elevational view of the device of FIG. 1;

FIG. 4 a top plan view of the device of FIG. 1; and

FIG. 5 is a fragmentary front elevational view of another embodiment of an ornamental scroll device of the invention.

DETAILED DESCRIPTION

The ornamental scroll device, generally designated 10, includes a flexible sheet member 12 having two opposed outer end portions, two outer edges **12*a*, and an indicia bearing section having a message 12*b* located on an obverse side of flexible sheet 12 and between outer edges 12*a*** and end portions as shown.

A single rigid sheet of material 14 is adhesively secured to the reverse side of flexible sheet 12 to fix sheet 12 in an out-stretched condition as shown. Thus rigid member 14 has a length effective to extend between the centerlines of each roll section 16 as shown. Thus rigid member 14 provides support for maintaining and strengthening of the adhesive connections 19 for roll sections 16.

Two end sections of flexible line 20 are fixed between rigid member 14 and reverse side of sheet 12 to hang device 10 for display of the indicia bearing section. Instead of a flexible line 10, a magnet member may be adhesively secured to the stiffened flexible sheet for magnetically holding device 10 to display the indicia bearing section. Such a magnet would be fastened in a well known way such as shown in Design patent D267,020, the disclosure of which is incorporated herein by reference in its entirety.

Roll sections 16 include a dowel section 13 located between two end cap members 11. As shown in FIG. 2, dowel section 13 has a circumferential surface adhesively secured to an outer end portion of sheet 12 that is rolled about the entire circumferential surface of dowel section 13 to form roll section 16. Dowel sections 13 have a length that is shorter than the overall width of flexible sheet 12 to provide open-mouthed pockets 18 for receiving coupling section 11*a* of the cap member located at each end of roll section 16.

Coupling sections 11*a* are adhesively secured within pockets 18 while exposing end cap knob sections that project outwardly from the ends of roll sections 16 as shown. Roll sections 16 are adhesively secured to outer end edges 19 of the indicia bearing section 12. A hot glue Gun may be used to secure edges 19.

The embodiment of FIG. 5 includes a theme-related article 15 disposed on the roll section 16 to augment the message of the indicia bearing section 12. In this specific embodiment, the theme-related article is a holly spring with berry with a Christmas theme associated with the particular message 12*b*.

In a particular embodiment, parchment paper forms flexible sheet 12. The two outer edges 12*a* are burned with a wood burning tool. After the edges are burned, the charred edges are cleaned with a toothbrush and wiped clean with a piece of paper towel.

A tacky Glue is placed on the pre-cut rigid member 14 which is a stiff piece of cardboard. The flexible line 20 is a piece of embroidery thread having its two ends adhered between the pre-cut cardboard member 14 and the reverse side of indicia bearing section 12.

Hot glue is used to attach the two end sections of the parchment paper to the dowel sections. Depending on the width of the scroll, the dowel sections may be 5/16th by 1½ inch or 5/16 by 2 inches. After application of the hot glue, the outer ends of the parchment paper is rolled and secured with more hot glue. At outer edge 19 of the indicia bearing section.

End caps 11 are mini-drawer pulls used for miniature furniture. Carpenter's glue or a more tacky glue secures the coupling sections 11*a* of each cap member. Cap members are pre-stained and the glue is allowed time to dry before packaging. Various other methods of attaching hanging members are within the contemplation of the invention.

While an ornamental scroll device has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. An ornamental scroll device comprising:

a) flexible sheet means including two opposed outer end portions, two opposed outer edges, and an indicia bearing section having a message located on an obverse side of the flexible sheet means and between the end portions and outer edges, b) stiffening means maintain the indicia bearing section rigid between the outer end portions, c) each of the outer end portions including a roll section having two cap means secured at opposite ends of each roll section, and d) location fixing means for displaying the indicia bearing section, e) the flexible sheet means includes a single piece of flexible sheet material having outer end sections wrapped around the dowel sections to form the outer end portions, f) each said roll sections includes a dowel section having a length that is shorter than the overall width of the sheet material to provide open-mouth pockets for receiving a cap means at each end of the roll section.

2. An ornamental scroll device as defined in claim 1 wherein the stiffening means includes a single rigid member secured to the reverse side of the flexible sheet means, said rigid sheet being effective to maintain the flexible sheet means in an outstretched condition.

3. An ornamental scroll device as defined in claim 1 wherein the stiffening means includes a single rigid sheet of material secured to a reverse side of the flexible sheet means, said rigid sheet being effective to fix the flexible sheet means in an outstretched condition.

4. An ornamental scroll device as defined in claim 3 wherein the rigid sheet of material is secured to the reverse side of the flexible sheet means with an adhesive material.

5. An ornamental scroll device as defined in claim 1 wherein the location fixing means includes magnet means for magnetically holding the device for display of the indicia bearing section.

6. An ornamental scroll device as device as in claim 1 wherein each cap means includes a coupling section and an outer head section, the coupling section of each cap means being fixedly disposed in an open-mouth pocket at the end of each roll section.

7. An ornamental scroll device as defined in claim 1 wherein the flexible sheet means includes a theme-related article disposed to augment the message of the indicia bearing section.

8. An ornamental scroll device comprising:

a) a single flexible sheet of material including two opposed outer end portions, two opposed outer edges, and an indicia bearing section having a message disposed on an obverse side of the flexible sheet, b) stiffening means fixedly secured to a reverse side of said flexible sheet for maintaining the indicia bearing section in a fixed outstretched condition between the outer end portions, c) each of the outer end portions including a roll section having two cap means secured at opposite ends of each roll section, and d) location fixing means for displaying the indicia bearing section, e) the roll section includes a dowel section having a circumferential surface and being located between the two cap means, f) the flexible sheet includes outer end sections wrapped around the respective circumferential surfaces of the dowel sections to form the outer end portions, g) each said dowel section having a length that is shorter than the overall width of the sheet material to provide open-mouth pockets for receiving a cap means at each end of the roll section.

9. An ornamental scroll device as defined in claim 8 wherein the stiffening means includes at least one rigid member secured to a reverse side of the flexible sheet, adhesive material secures the rigid member to the reverse side of the flexible sheet.

10. An ornamental scroll device as defined in claim 9 wherein the location fixing means includes a flexible line having two end sections disposed between the rigid sheet of material and the flexible sheet means.

11. An ornamental scroll device as defined in claim 8 wherein each cap means includes a coupling section and an outer head section, the coupling section of each cap means being fixedly disposed in an open-mouth end of each roll section.

12. An ornamental scroll device comprising:

a) a single flexible sheet of material including two opposed outer end portions, two opposed outer edges, and an indicia bearing section having a message disposed on an obverse side of the flexible sheet, b) stiffening means for maintaining the indicia bearing section in an outstretched condition between the outer end portions, c) each of the outer end portions including a roll section having two cap means secured at opposite ends of each roll section, and d) location fixing means for displaying the indicia bearing section, e) the roll section includes a dowel section having a circumferential surface and being located between the two cap means, f) the flexible sheet includes outer end sections wrapped around the respective circumferential surfaces of the dowel sections to form the outer end portions, g) each cap means including a single cap member having a knob section end a coupling section, h) each said circumferential surface being fixedly secured to an outer end portion that is rolled about the entire circumferential surface to form the roll section, i) the dowel sections having a length that is shorter than the overall width of the flexible sheet of material to provide open-mouth pockets for receiving the coupling section of the cap member at each end of the roll section, j) said coupling sections being fixedly secured within the pockets while exposing the knob sections that project outwardly from the ends of the roll sections, k) said roll sections being adhesively secured to an outer end edge of the indicia bearing section.

13. An ornamental scroll device as defined in claim 12 wherein adhesive material fixedly secures said circumferential surface to said outer end portion and said coupling sections within said open-mouth pockets.

* * * * *